US008474652B2

(12) United States Patent
Yaros

(10) Patent No.: US 8,474,652 B2
(45) Date of Patent: Jul. 2, 2013

(54) MOIST TOWELETTE DISPENSING APPARATUS

(76) Inventor: Andrew Yaros, Solana Beach, CA (US)

( * ) Notice: Subject to any disclaimer, the term of this patent is extended or adjusted under 35 U.S.C. 154(b) by 336 days.

(21) Appl. No.: 12/534,049

(22) Filed: Jul. 31, 2009

(65) Prior Publication Data

US 2010/0025419 A1 Feb. 4, 2010

Related U.S. Application Data

(60) Provisional application No. 61/085,326, filed on Jul. 31, 2009.

(51) Int. Cl.
*A47K 10/24* (2006.01)

(52) U.S. Cl.
USPC ..... 221/94; 221/34; 221/45

(58) Field of Classification Search
USPC ..... 221/34, 45–49, 61, 92, 94, 199, 283
See application file for complete search history.

(56) References Cited

U.S. PATENT DOCUMENTS

| | | | | | |
|---|---|---|---|---|---|
| 3,086,724 | A * | 4/1963 | Powell | 242/598.6 |
| 4,004,687 | A * | 1/1977 | Boone | 206/233 |
| D259,682 | S * | 6/1981 | Standing | D6/523 |
| 4,354,643 | A * | 10/1982 | Kenner | 242/598.5 |
| 4,890,205 | A * | 12/1989 | Shaffer | 362/154 |
| 5,868,346 | A * | 2/1999 | Cobos | 242/593 |
| 7,837,060 | B2 * | 11/2010 | Mullett et al. | 221/132 |
| 2004/0075015 | A1 * | 4/2004 | Cain et al. | 242/595 |

* cited by examiner

*Primary Examiner* — Gene Crawford
*Assistant Examiner* — Kelvin L Randall, Jr.
(74) *Attorney, Agent, or Firm* — Donn K. Harms

(57) ABSTRACT

A moist towelette dispenser device adapted for use in combination with a toilet paper holder assembly having an elongated cylindrical spindle with two ends engageable which mount on a conventional toilet paper fixture to support a roll of toilet paper. The device provides for concurrent dispensing of toilet paper and moist towelettes and an air freshener. A housing provides a dispensing site for the towelettes and is engageable to the room mount by two elongated members. The toilet paper is operatively mounted on the spindle engaged between the members.

4 Claims, 4 Drawing Sheets

MOIST TOWELETTE DISPENSING APPARATUS

FIELD OF THE INVENTION

The device herein described and disclosed relates to personal hygiene and the employment of moist towelettes. More particularly it relates to a device adapted for engagement with a conventional toilet paper mount which has an enclosure adapted for engagement to a container of moist towelettes.

BACKGROUND OF THE INVENTION

Over the last decade, pre-moistened towelettes have become a widely employed means for personal hygiene. Such towelettes are conventionally pre-moistened with any of a plurality of liquids which clean and may have antibacterial properties. Other such towelettes may be pre-moistened with skin softeners or medications for employment by a user in daily hygiene or medication purposes. Conventionally, moist towelettes are sold in containers which maintain the moist nature of the towelettes inside and provide an easy means to dispense individual towelettes.

Personal hygiene, while in a bathroom, has become an ever more favored means of employment of such towelettes. Such towelette dispensers provide easy access to individual towelettes to users in a bathroom while standing in front of the sink or bathroom counter on which the towelette container is supported. However, with bathroom counter top space becoming ever more crowded, it frequently becomes a choice of which hygiene appliance and which personal hygiene product is given counter space at the expense of other favored products.

Additionally, the toilet in modern bathrooms is frequently in a smaller room housed in the bathroom yet separated from the main area by a door and wall surrounding it. In such small areas, there is frequently no counter space provided at all because of the limited use of the room for its short term occupant. However, it is becoming more and more popular to employ towelettes, in place of or along with toilet paper, in personal hygiene after using the toilet. This is especially true where the application of medications is required or desired to treat or comfort skin or other problems which may be causing discomfort for users of the toilet.

However, due to the limited space in the small area, and due to the proclivity of other users of a bathroom to remove towelettes from the counter top, it becomes a vexing problem to provide such towelettes in a location proximate to the user of the toilet. This is especially true where multiple people may use the same toilet, but not all wish to use, or need, the towelettes subsequent to finishing up their stay on the toilet.

As such, there exists an unmet need for a container, or a mount for a container, that is positioned adjacent to a roll of toilet paper. Such a device should accommodate the needs of users of towelettes, yet not displace the roll of toilet paper that others may use or which may be employed in combination with towelettes.

Further, such a device should provide a means for engagement of a plurality of different types of towelettes for easy dispensing within arms reach of a toilet user.

With respect to the above, before explaining at least one preferred embodiment of the towelette dispensing invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein, are for the purpose of description, and should not be regarded as limiting in any manner.

As such, those skilled in the art will appreciate that the concept upon which this disclosure is based may readily be utilized as a basis for designing of other devices for the dispensing of towelettes concurrently and proximate to the dispensing of toilet paper. It is important, therefore, that the objects of this invention, and claims herein, be regarded as including any such equivalent construction and methodology as would occur to those skilled in the art insofar as they do not depart from the spirit and scope of the present invention.

SUMMARY OF THE INVENTION

The device as herein disclosed and described provides a housing adapted to either contain a supply of towelettes internally, or to provide a means to engage a container of towelettes internally. In this fashion, the housing can operate as its own dispenser of sequentially dispensed towelettes, or can have an internal cavity adapted to engage with a container of towelettes to provide easy means to restock, or change the nature of the dispensed towelettes.

The device features a novel means to engage the conventional projecting or recessed holes for a toilet paper roll mount. Such mounts conventionally employ a member that is telescopic in nature and biased toward its distal ends by an internal spring. This urges the distal ends of the member away from the center of the member and into a firm engagement with the recesses of the projecting or recessed mount. In spite of lacking adequate counter space, virtually every bathroom in the modern world employs some mode of this member and mount system to hold rolls of toilet tissued for use in the bathroom. Because of the precarious position such tissue users occupy during use of the toilet tissue, such dispensers must be within easy reach of the user at all times while in such a position.

The device herein allows for the concurrent positioning of both toilet tissue and moist towelettes, within easy reach of a user finishing up on the toilet and going about a final act of personal hygiene. It does so by employing a pair of projecting opposing planar members, which have projecting exterior portions adapted to engage within the recessed holes of the mount for the telescopic biased member. On the opposite side of the projecting planar members are a pair of opposing recesses adapted to engage the biased telescopic member which supports the toilet paper roll. The space between the planar members is adapted to allow the toilet paper roll to spin on the axis provided by the telescopic member and thereby dispense sheets of paper to the user. A novel guide slot provides a means to direct the paper forward of the housing when a user pulls on the distal end of the roll which may be advanced through the guide slot.

On the opposite end of the planar members, from the opposing recesses for the telescopic member, is located a cavity which is adapted for engagement with one or both of, a supply of moist towelettes housed in the cavity, or, a container holding a supply of such towelettes.

In an especially favored mode of the device, the diameter of the cavity would be such that it would frictionally engage the exterior of a container of towelettes. This would allow for the easy replacement of the supply when used, or when a different moistening agent is desired for medication or hygiene purposes.

In use, the person finishing up from employment of the toilet has the option of using one or both of the toilet paper or the towelettes for their hygiene purposes. This unique combination is provided within easy reach of the user in their frequently precarious position during such a use, and without the need for any counter space in the room hosting the toilet, thereby allowing for wide use of the device.

It is thus an object of this invention to provide a convention housing for moist towelettes within easy reach of user leaving a stay on the toilet.

It is a further object of this invention to provide such a towelette dispenser which requires no counter space and will engage with virtually any conventionally employed toilet paper housing.

With respect to the above description and background, as noted earlier, before explaining at least one preferred embodiment of the invention in detail, it is to be understood that the invention is not limited in its application to the details of construction and to the arrangement of the components set forth in the following detailed description or illustrated in the drawings. The various apparatus of the invention herein described and disclosed are capable of other embodiments and of being practiced and carried out in various ways which will be obvious to those skilled in the art once they review this disclosure.

As such, those skilled in the art will appreciate that the conception upon which this disclosure is based may readily be utilized as a basis for designing of other devices for engagement with toilet tissue dispensers and concurrent dispensing of tissue and towelettes therefrom. It is important, therefore, that the objects and claims be regarded as including such equivalent construction and methodology, insofar as they do not depart from the spirit and scope of the present invention.

DETAILED DESCRIPTION OF PREFERRED EMBODIMENTS

Figure 1:
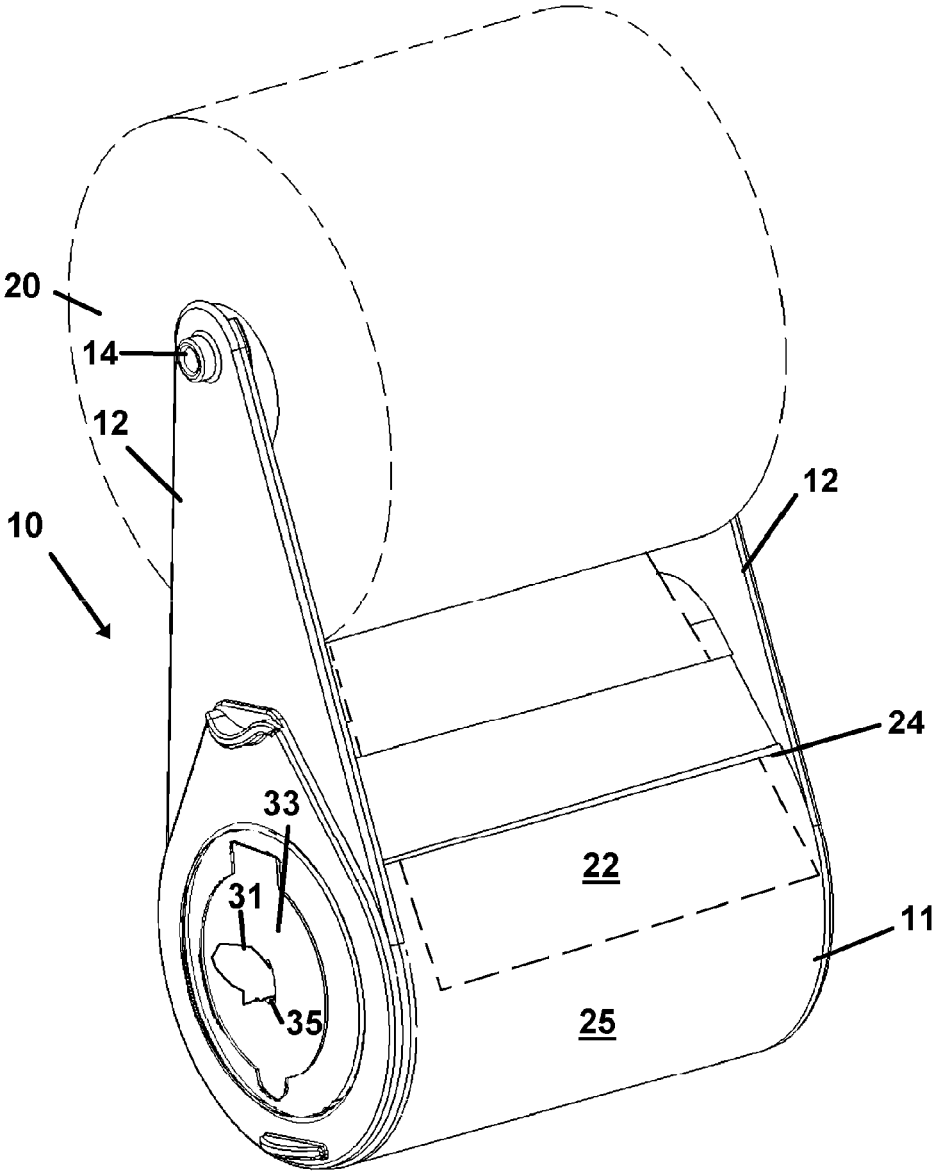
FIG. 1 depicts a perspective view of the device in the as-used position, showing planar members and projections therefrom adapted to engage the conventional recesses used in a toilet paper mount.
Figure 2:
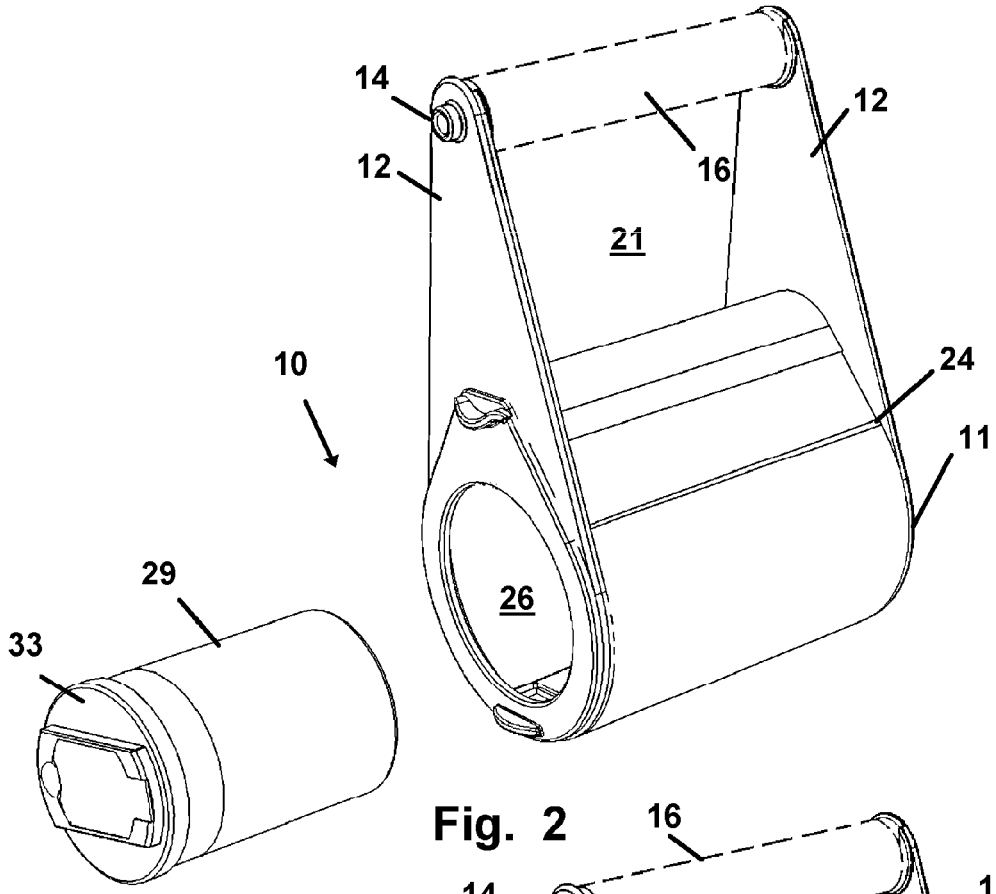
FIG. 2 is a perspective frontal view of the device showing the conventional toilet paper telescopic member engaged within the members and a frictionally engageable moist wipe container.
Figure 3:
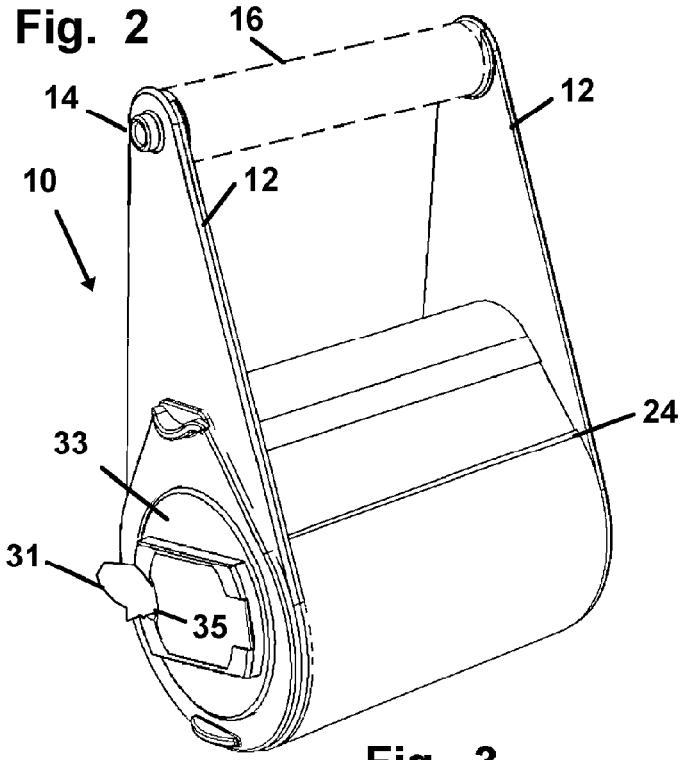
FIG. 3 is a perspective view of the device of FIG. 2 depicting the wipe container engaged within a cavity of a housing.

Referring now to FIGS. 1-6, as noted FIGS. 1-3 depict a perspective view of the device 10 which provides a housing 11 at first ends of a pair of opposing planar members 12. At the opposite end of the planar members 12 is provided a means to engage the device 10 with a conventional projecting or recessed mount, provided on a wall or surface in bathrooms of most homes and businesses. The conventional mount (not shown but well known) is provided for replaceable engagement with a conventional telescopic member 16 which is employed to support a toilet paper roll 20 in position for use wherein the paper wound on the roll 20 is pulled to dispense it causing the roll 20 to rotate on the telescopic member 16.

The depicted means to engage the device 10 with the noted conventional mount for the member 16, employs the pair of projecting opposing planar members 12, each of which have opposing exterior projections 14, positioned on the members 12 in a manner adapted to engage the recessed holes of the conventional mount which normally engages the biased telescopic member 16.

The planar members 12 are formed of resilient material having a memory for position. Consequently, the distal ends of the planar members 12 may be moved toward each other to allow engagement of the projections 14 with the mount at a home or business and will naturally bias away from each other and into the recesses of the conventional mount.

Figure 6:
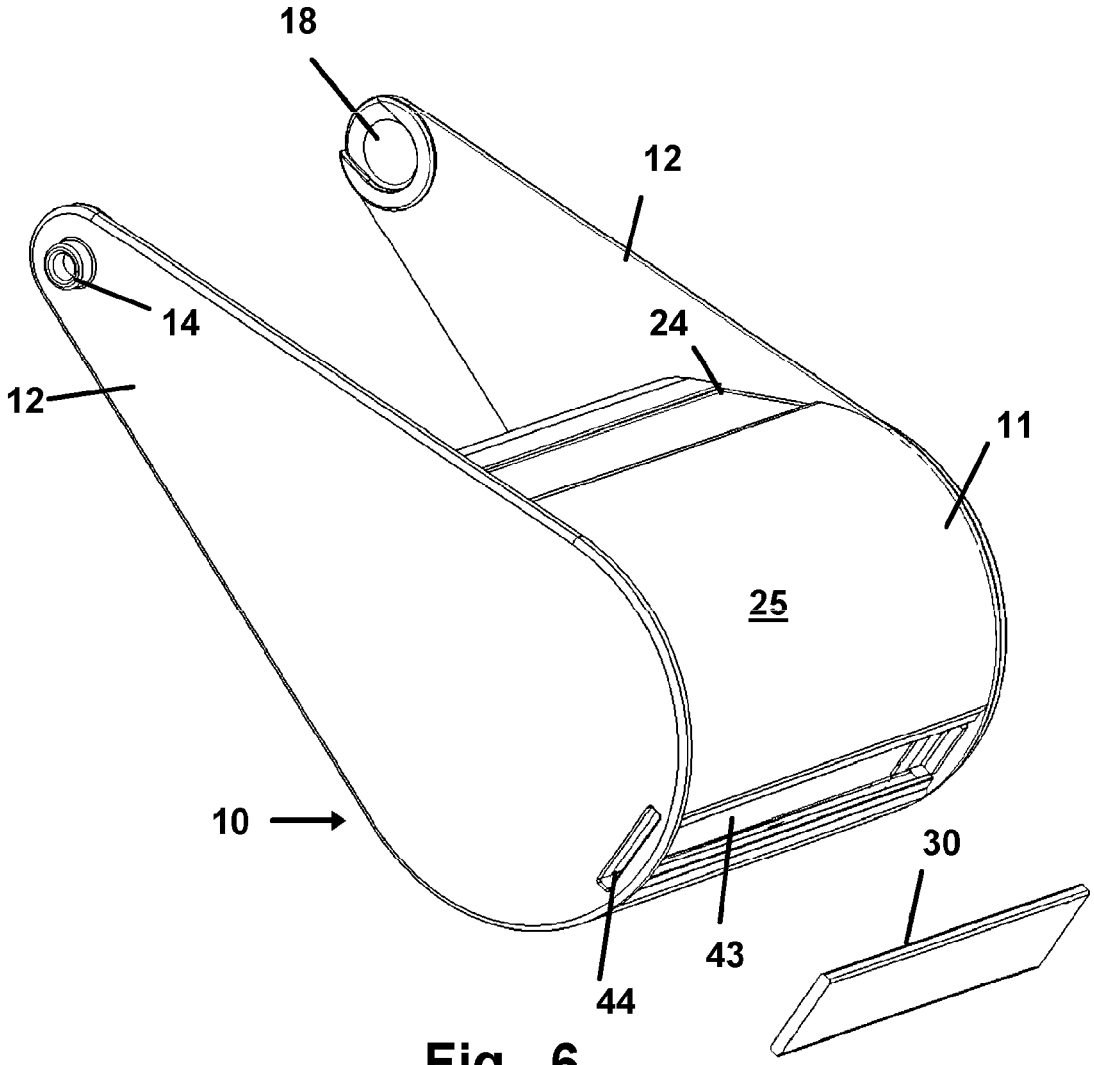
FIG. 6 shows a bottom perspective view of the device and the air freshener adapted for engagement to a mount with the exterior of the housing bottom.

As can be seen in FIG. 6, on the opposite side of the distal ends of the projecting planar members 12 from the projections 14 are positioned opposing recesses 18. These recesses 18 are adapted to engage the biased telescopic member 16, which exists already in most bathrooms having the wall or surface mount to support the toilet paper roll 20 adjacent to the toilet.

Figure 4:
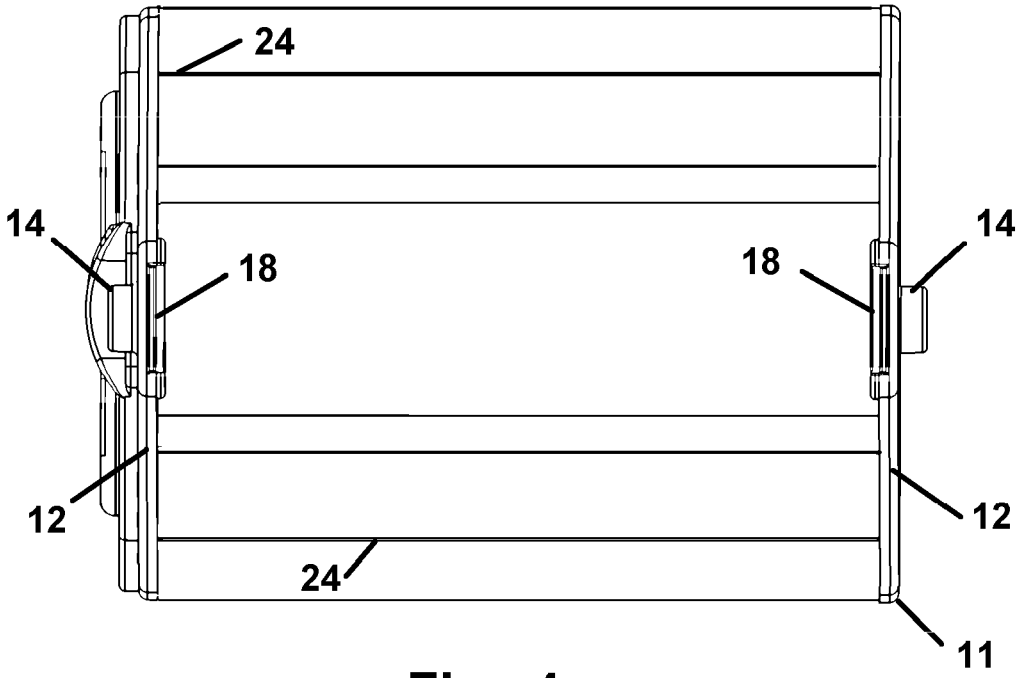
FIG. 4 is a top plan view of the device showing the projections positioned for engagement with a conventional toilet paper holder and races on both sides of the housing adapted to guide sheets of paper therethrough.
Figure 5:
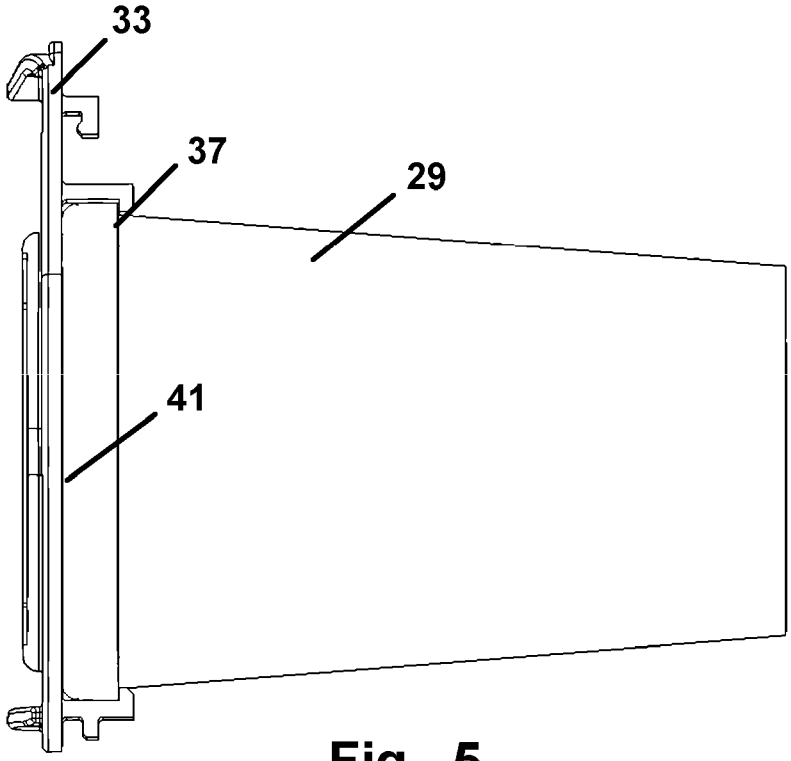
FIG. 5 depicts another mode of the wipe container adapted to engage with a cover for the housing cavity and for axial positioning with the cavity held horizontal by the cover engagement.

A gap 21 is defined by the area between the planar members 12 and is adapted to allow the toilet paper roll 20 to spin on the axis provided by the telescopic member 16 when engaged in the recesses 18 and thereby dispense sheets of paper from a distal end 22 of the roll 20. As can be seen in FIG. 1-3 and in FIG. 4, while not required, for a cleaner installation and means to keep the distal end 22 of the roll 20 from becoming hidden behind the roll 20 or housing 11, guide slots 24 are provided as a means to direct the distal end 22 of the paper during use. Placement of the guide slots 24 on both sides of the housing 11 as shown in FIG. 4, allow for their use in either a right handed or left handed mount adjacent to a toilet, which depends upon which side of the toilet the conventional mount for the existing member 16 is placed.

On the opposite end of the planar members 12 from the engaged telescopic member 16, formed within the sidewall 25 of the housing 11, a cavity 26 is provided which is adapted for engagement with one or both of, a supply of moist towelettes which may be placed and housed in the cavity 26, or, the exterior of a conventional retail container 29 which holds a supply of such towelettes 31. When the device 10 is engaged with the mount in a bathroom in the as-used position of FIG. 1, the towelettes 31 will project slightly from the cover 33 thereby positioning of the towelette 31 supply within the cavity 26, and immediately adjacent and easily reachable by a user. As shown, the towelettes 31 project from a cover 33 which would either engage the housing 11 or a container 29 depending on whether the towelettes 31 are provided in the container 29 or as a dispensable stack just housed in the cavity 26.

Of course those skilled in the art will no doubt realize that other configurations may be employed to provide a dispensable supply of towelettes 31 from such a device 10 and any such mode of dispensing towelettes 31 from a housing 11 adapted to engage both a toilet paper mount and a support for a toilet paper roll 20 are anticipated to be within the scope of this application.

If the device 10 is configured to use the cavity 26 to house a supply of towelettes 31, the cavity 26 would feature an engageable removable cover 33 through which individual towelettes 31 would dispense sequentially from the housed supply. Alternatively, the cover 33 could provide access to the cavity 26 for insertion of a towelette 31 supply which would be dispensed through a wall of the device 10 and a cover 33 would seal the cavity 26 to sufficiently maintain the towelettes 31 in their moist state until dispensed.

If the device 10 is adapted for employment of conventional retail containers 29 housing the towelettes 21, the cavity 26 would have a diameter adapted to accommodate the exterior of the towelette container 29, and will be sufficiently long axially, to allow insertion of the container 29 into the cavity 26.

Should the cavity 26 be adapted to accommodate conventionally sold containers 29 of towelettes 31, such as those in grocery stores, a frictional or other removable means for operative engagement between the cavity 26, and the conventional container 29 would be provided. Such an engagement would be adapted to provide a means to hold the container 29 in a removable and replaceable engagement for use, and to place the dispensing aperture 35 for dispensing towelettes 31 at a side surface of the device 10. Further, such an engagement would provide for easy replacement of the container 29 such as a frictional engagement with the exterior surface of the container 29.

Alternatively, the device 10 may be provided in a manner adapted to engage the container 29 using the cover 33 which would be adapted to both hold the container 29 axially disposed in the cavity 26 and allow for easy removal and replacement. The cover 33 would have means for engagement to the exterior of the device 10 adjacent to the housing 11 defining the cavity 26 within. A first end 37 of the container 29 would be adapted for removable engagement with an interior surface 41 of the cover 33. The cover 33 would be adapted to engage with the exterior of the device 10 in the area of the housing 11 to allow for insertion of the container 29 into the cavity 26. The container 29 would be held in the cavity 26 by its engagement to the cover 33 and the cover's engagement to the housing 11.

This alternative mode of mounting the container 29 to the cover 33 would be preferred if the device 10 were to be sold as a unit with the containers 29 of towelettes 31 which would be replaceable. In that fashion the provider of the device 10 and the user, would be assured of a supply of containers 29 of towelettes which will engage operatively with the device. Further, if the towelettes 31 were prescription only or employed for some special hygienic reason, it would insure that the user cannot engage a conventional retail towelette container by mistake.

In a particularly preferred mode of the device 10, an air freshener 30 component can be provided, which is adapted for engagement with the exterior of the housing 11 or the planar members 12. The addition to scents in bathrooms and the like is preferred in many households and businesses. With this component, the device 10 would provide a recess 43 formed in either the housing 11 as shown, or it might be formed in one of the planar members 12. If formed in the bottom of the housing 11 as shown in FIG. 6, the air freshener 30 would provide a pleasant scent to the room in which the device is placed, but would also be out of sight.

As shown in FIG. 6, in a preferred mode of the device 10 which would allow for convenient replacement of the air freshener 30 component, the air freshener 30 component is adapted for a slide-in engagement with a recess 43 or second cavity of the device 10 through an aperture 44. The recess 43 engaging the air freshener 30 may be adapted to engage with commercially available air freshener containers or one that is designed for engagement with the device 10 wherein refills would be made available. An opening on a side of the recess 43 provides a means for the scent impregnated to the air freshener 30 component to escape and improve the odor in the room in which the device is located.

While the present invention has been described herein with reference to particular embodiments thereof, a latitude of modifications, various changes and substitutions are intended in the foregoing disclosure, and it will be appreciated that in some instance, some features of the invention could be employed without a corresponding use of other features without departing from the scope of the invention as set forth in the following claims. All such changes, alternations and modifications, as would occur to those skilled in the art, are considered to be within the scope of this invention as broadly defined in the appended claims.

What is claimed is:

1. A moist towelette dispenser apparatus for use in combination with a toilet paper holder assembly having an elongated cylindrical spindle with two ends engageable with mounts on a toilet paper fixture, for supporting a roll of toilet paper surrounding the spindle, said combination towelette dispenser apparatus and toilet paper holder comprising:

a housing;

a pair of members extending from said housing to distal ends;

each of said pair of members having a first side surface and having a second side surface;

a gap formed between said members from said distal ends to said housing;

a pair of engagement points for said two ends of said spindle, a respective one of said pair of engagement points positioned at a respective said distal end of each of said pair of members, said pair of engagement points providing a mount for said spindle to an engaged position with each of said two ends of said spindle operatively engaged with a respective one of said pair of engagement points;

cooperative mounts positioned on said second side surfaces of said members, said second side surfaces being opposite said first side surfaces, said cooperative mounts adapted for cooperative engagement with said mounts on said toilet paper fixture;

a gap between said members extending substantially from said distal ends to said housing, said gap sized to accommodate a roll of toilet paper surrounding said spindle in said engaged position;

at least one elongated slot formed across a first exterior surface of said housing;

said slot having a width to accommodate a sliding of said toilet paper therethrough;

said slot provides a means to guide said toilet paper therethrough and to maintain a distal end of said toilet paper, formed when a section of said toilet paper is torn from said roll, extending from said slot;

a second said slot formed on a second exterior surface of said housing;

said second exterior surface being on an opposite side of said housing from said first exterior surface;

said spindle in said engaged positioned between said first and second slots;

said housing having a cavity formed therein accessible through an aperture;

said cavity sized to accommodate a supply of moist towelettes therein; and said aperture providing means to dispense individual said towelettes therethrough, whereby said towelette dispenser may be engaged with a said toilet paper fixture on either side of a toilet and one of said first or second slots provides said means to maintain a distal end of said toilet paper extending therefrom, and a supply of said towelettes in said cavity are concurrently available with said toilet paper to a user.

2. The moist towelette dispenser apparatus of claim 1 additionally comprising:

a container surrounding said supply of towelettes;

said container having an exterior surface;

said container having an endwall having an dispensing aperture therein for removal of individual said towelettes therethrough; and means for a removable engagement of said container within said cavity and said endwall adjacent to said aperture, whereby said towelettes are dispensed through said dispensing aperture with said container in said removable engagement, and said container may be replaced with a new said container of said towelettes to replenish a supply of said towelettes.

3. The moist towelette dispenser apparatus of claim 2 wherein said means for a removable engagement of said container comprises:

a frictional engagement of said exterior surface of said container within said cavity.

4. The moist towelette dispenser apparatus of claim 2 wherein said means for a removable engagement of said container comprises:

a lid cooperatively engageable over said aperture on a first surface to an attached position;

said lid having a dispensing aperture therein communicating between said first surface and an opposite second surface;

said container having an open end engageable to said first side of said lid in an attached position; and said container said attached position extending into said cavity.

* * * * *